US009567817B2

(12) United States Patent
Chambers

(10) Patent No.: US 9,567,817 B2
(45) Date of Patent: Feb. 14, 2017

(54) ROTATING CONTROL DEVICE RADIAL SEAL PROTECTION

(71) Applicant: Weatherford Technology Holdings, LLC, Houston, TX (US)

(72) Inventor: James W. Chambers, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 27 days.

(21) Appl. No.: 14/725,748

(22) Filed: May 29, 2015

(65) Prior Publication Data

US 2015/0345237 A1 Dec. 3, 2015

Related U.S. Application Data

(60) Provisional application No. 62/004,665, filed on May 29, 2014.

(51) Int. Cl.
*E21B 19/24* (2006.01)
*E21B 33/03* (2006.01)
*E21B 33/08* (2006.01)

(52) U.S. Cl.
CPC ..... *E21B 19/24* (2013.01); *E21B 33/03* (2013.01); *E21B 33/085* (2013.01)

(58) Field of Classification Search
CPC ..... E21B 19/24; E21B 33/085; E21B 33/03; E21B 33/08; F16J 15/441; F16J 15/324
USPC ..... 277/322, 324, 326
See application file for complete search history.

(56) References Cited

U.S. PATENT DOCUMENTS 7,836,946 B2 * 11/2010 Bailey ..... E21B 33/085 166/84.2
2011/0024195 A1 2/2011 Hoyer et al.
2011/0036629 A1 * 2/2011 Bailey ..... E21B 33/085 175/48
2011/0036638 A1 2/2011 Sokol et al.
(Continued)

FOREIGN PATENT DOCUMENTS

CN 202900137 U 4/2013
GB 2394741 A 5/2004

OTHER PUBLICATIONS

Search Report and Written Opinion issued Oct. 30, 2015 for International Application No. PCT/US15/33313, 9 pages.
(Continued)

*Primary Examiner* — Michael Wills, III
(74) *Attorney, Agent, or Firm* — Smith IP Services, P.C.

(57) ABSTRACT

The exemplary embodiments relate to apparatus and methods for increasing the longevity of an RCD at a wellbore, including a bearing assembly configured for operating in the RCD. The bearing assembly is configured for reducing pressure proximate the bearing assembly including reducing pressure in a radial seal. Top and bottom seals are mounted against a wear sleeve adjacent to an inner member housed within the bearing assembly. The wear sleeve is configured to be sealed by the top seal and the bottom seal as the inner member rotates in the RCD. A pressure reduction system mounted with the RCD is configured to apply pressure via a wellbore pressure between the top seal and the bottom seal, which is lower relative to a pressure above the top seal, and which is higher relative to a pressure below the bottom seal.

27 Claims, 4 Drawing Sheets

(56) References Cited

U.S. PATENT DOCUMENTS

| | | | | |
|---|---|---|---|---|
| 2011/0127725 | A1* | 6/2011 | Dietle | F16J 15/441<br>277/300 |
| 2011/0168382 | A1* | 7/2011 | Bailey | E21B 33/085<br>166/82.1 |

OTHER PUBLICATIONS

English Abstract of CN 202900137 published Apr. 24, 2013, 1 page.

* cited by examiner

ROTATING CONTROL DEVICE RADIAL SEAL PROTECTION

CROSS-REFERENCE TO RELATED APPLICATIONS

This application claims the benefit of U.S. Provisional Application No. 62/004,665 filed May 29, 2014 the disclosure of which is hereby incorporated by reference.

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM

Not Applicable.

BACKGROUND

Technical Field

The subject matter generally relates to systems and techniques in the field of oil and gas operations. Reduction of pressure, velocity and/or temperature on seals in rotating control devices (RCDs) improves the life of such seals in RCDs.

When a well site is completed, pressure control equipment may be placed near the surface of the earth. The pressure control equipment may control the pressure in the wellbore while drilling, completing and producing the wellbore. The pressure control equipment may include blowout preventers (BOP), rotating control devices (RCDs), and the like. The RCD is a drill-through device with a rotating seal that contacts and seals against the drill string (drill pipe with tool joints, casing, drill collars, Kelly, etc.) for the purposes of controlling the pressure or fluid flow to the surface.

RCDs and other pressure control equipment are used in underbalanced drilling (UBD) and managed pressure drilling (MPD), which are relatively new and improved drilling techniques, and work particularly well in certain offshore drilling environments. Both technologies are enabled by drilling with a closed and pressurizable circulating fluid system as compared to a drilling system that is open-to-atmosphere at the surface. Managed pressure drilling is an adaptive drilling process used to more precisely control the annular pressure profile throughout the wellbore. MPD addresses the drill-ability of a prospect, typically by being able to adjust the equivalent mud weight with the intent of staying within a "drilling window" to a deeper depth and reducing drilling non-productive time in the process. The drilling window changes with depth and is typically described as the equivalent mud weight required to drill between the formation pressure and the pressure at which an underground blowout or loss of circulation would occur. The equivalent weight of the mud and cuttings in the annulus is controlled with fewer interruptions to drilling progress while being kept above the formation pressure at all times. An influx of formation fluids is not invited to flow to the surface while drilling. Underbalanced drilling (UBD) is drilling with the hydrostatic head of the drilling fluid intentionally designed to be lower than the pressure of the formations being drilled, typically to improve the well's productivity upon completion by avoiding invasive mud and cuttings damage while drilling. An influx of formation fluids is therefore invited to flow to the surface while drilling. The hydrostatic head of the fluid may naturally be less than the formation pressure, or it can be induced.

The thrust generated by the wellbore fluid pressure, the radial forces on the bearing assembly within the RCD and other forces cause a substantial amount of heat, pressure, and friction to build in the conventional RCD. The stress causes the seals and bearings to wear and subsequently require repair. The conventional RCD typically requires an external control system that circulates fluid and utilizes various valves and hose through the bearings and near seals in order to regulate pressure and stress. However, risers, used in many oilfield operations, particularly subsea operations, may pose significant obstacles to the use of such pressure control systems, external coolants, lubricants, lubricating systems, cooling systems and/or other control systems.

An improved system for reducing pressure experienced by radial seals and the bearing section of an RCD is desired, particularly a system which is able to function in environments with or without an external control system. If the pressure exposed to radial seals is not regulated, the pressure limitations of the seal material may be reached and degradation of the radial seal may begin. The life of the seal is related to the factors of pressure, velocity and temperature conditions over time. In order to obtain a sufficient life from the radial seal(s), the rate of pressure reduction should be fast enough to allow the pressure at the sealing surface to level off at a pressure lower than that of the seal material's upper limit. Also, to protect the radial seals in an RCD, there is a need to regulate the differential pressure across the upper top radial seal that separates the fluid from the environment.

US Pub. No. 2006/0144622 proposes a system and method for cooling a RCD while regulating the pressure on its upper radial seal.

The above discussed U.S. Pub. No. US 2006/0144622 is incorporated herein by reference for all purposes in its entirety. The above referenced patent publication has been assigned to the assignee of the current disclosure.

BRIEF SUMMARY

The exemplary embodiments relate to apparatus and methods for increasing the longevity of an RCD at a wellbore, including a bearing assembly configured for operating in the RCD. The bearing assembly is configured for reducing pressure proximate the bearing assembly including reducing pressure in a radial seal. Top and bottom seals are mounted against a wear sleeve adjacent to an inner member housed within the bearing assembly. The wear sleeve is configured to be sealed by the top seal and the bottom seal as the inner member rotates in the RCD. A pressure reduction system mounted with the RCD is configured to apply pressure via a wellbore pressure between the top seal and the bottom seal, which is lower relative to a pressure above the top seal, and which is higher relative to a pressure below the bottom seal.

As used herein the term "RCD" or "RCDs" and the phrases "pressure control equipment", "pressure control apparatus" or "pressure control device(s)" shall refer to well related pressure control equipment/apparatus/device(s)

including, but not limited to, rotating-control-device(s), active rotating control devices, blowout preventers (BOPS), and the like.

As used here the term "reduction piston" shall refer to and include any equipment/apparatus/device(s) for adjusting, reducing, modifying pressure through the use of piston(s) including piston pressure reducers, or pressure modifiers and the like for which relief valves are not necessary.

BRIEF DESCRIPTION OF THE FIGURES

The exemplary embodiments may be better understood, and numerous objects, features, and advantages made apparent to those skilled in the art by referencing the accompanying drawings. These drawings are used to illustrate only exemplary embodiments, and are not to be considered limiting of its scope, for the disclosure may admit to other equally effective exemplary embodiments. The figures are not necessarily to scale and certain features and certain views of the figures may be shown exaggerated in scale or in schematic in the interest of clarity and conciseness.

DETAILED DESCRIPTION OF THE EXEMPLARY EMBODIMENT(S)

The description that follows includes exemplary apparatus, methods, techniques, and instruction sequences that embody techniques of the inventive subject matter. However, it is understood that the described exemplary embodiments may be practiced without these specific details.

Figure 1:
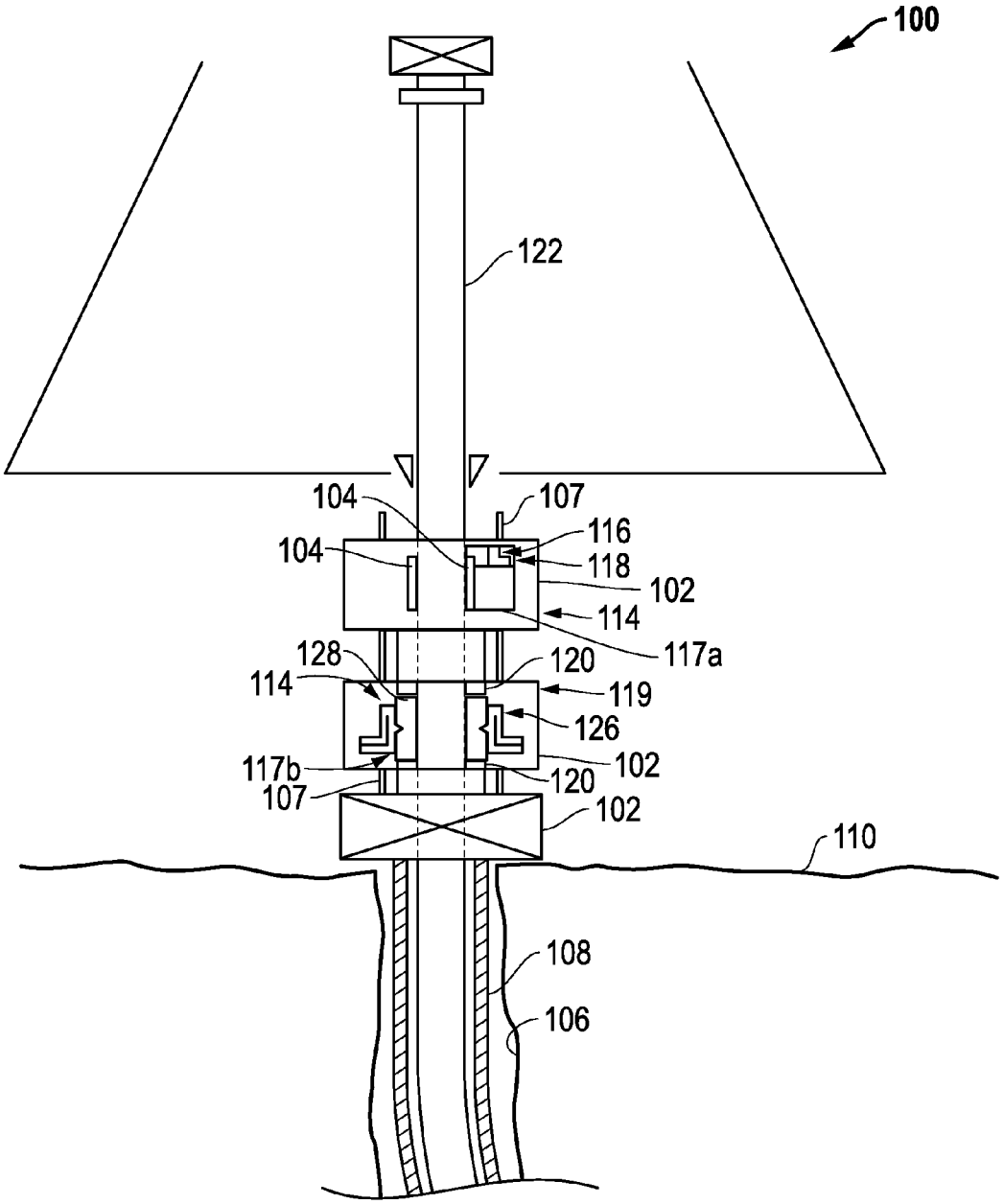
FIG. 1 depicts a schematic view of a well site having pressure control devices for sealing an item or piece of oilfield equipment.

FIG. 1 depicts a schematic view of a well site 100 having pressure control devices 102 for sealing a rotating drill string or other piece of oilfield equipment 122. The well site 100 may have a wellbore 106 formed in the earth and lined with a casing 108. At the Earth's surface or sea floor 110 (see, for example, US publication no, 2014/0027129 FIGS. 1, 1A and 1B and accompanying description depicting exemplary schematic views of fixed offshore rig and land wellsites which is incorporated herein by reference) the one or more pressure control devices 102 may control pressure in the wellbore 106. The pressure control devices 102 may include, but are not limited to, BOPS, RCDs, and the like. Riser(s) 107 may be positioned above, with and/or below the pressure control devices 102. The riser(s) 107 may present challenges to introducing pressure control, lubricants, coolants, lubrication systems and/or cooling systems for the pressure control devices 102. As shown, the top pressure control device 102 is an RCD 114. A staged seal 116 may be part of a bearing assembly 117*a* located in the RCD 114. The staged seal 116 may be a radial seal having a pressure reduction system 118. The pressure reduction system 118 may be a closed piston system configured to stage pressure across the staged seal 116, as will be described in more detail below. The staged seal 116 may be configured to engage/squeeze against and seal the inner member 104 during oilfield operations. The inner member 104 may be any suitable, rotatable equipment to be sealed by the staged seal 116.

The pressure control device 102 is located directly below the RCD 114 (as shown) and may be a sealing device 119. The sealing device 119 may have stripper rubbers 120 for sealing against the rotating drill string or other piece of oilfield equipment 122, and a bearing assembly 117*b*. The bearing assembly 117*b* may have a fixed latch 126 configured to engage a bearing 128. The stripper rubbers 120 may engage the rotating drill string 122 as the drill string 122 is inserted into or moved out of the wellbore 106. The fixed latch 126 may have a heat exchanger (not shown) built into the latch in order to cool the latch. The RCD 114 with the staged seal 116 do not necessarily, although can be, used above or with the RCD 114 with the sealing device 119.

Figure 2:
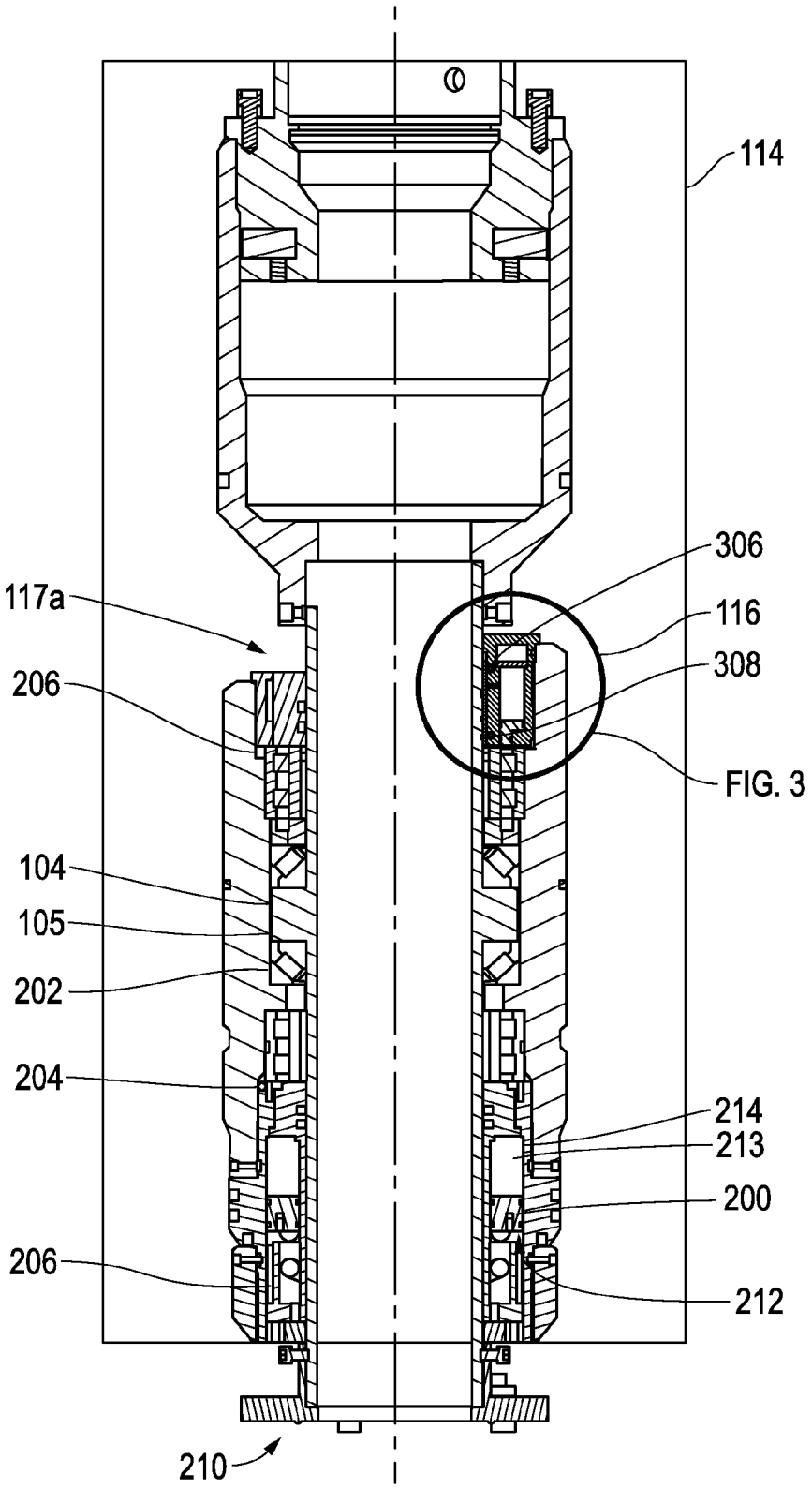
FIG. 2 depicts a schematic view of the RCD with a cross sectional view of the bearing assembly and the oilfield equipment.

FIG. 2 depicts a schematic view of the RCD 114 with a cross sectional view of the bearing assembly 117*a* and the inner member 104. The bearing assembly 117*a* may have a piston 200 coupled to a bearing 202, a bottom seal 204, the staged seal 116, one or more coiled springs 206, and a load flange 210. The bearing assembly 117*a* may allow the inner member 104 to rotate as the drill string 122 is run through the pressure control device 102. The inner member 104 rotates with or relative to the rotating drill string 122 as the drill string 122 is run into or out of the wellbore 106.

As the wellbore pressure increases during drilling, the wellbore pressure may apply a force 212 to the piston 200. The force 212 may be equivalent to the pressure in the wellbore 106 in an exemplary embodiment. In another exemplary embodiment, the force 212 may be less than the wellbore pressure. The pressure or force 212 exerted onto piston 200 may then be moved upwards thereby compressing a volume of fluid 213 located in a piston chamber 214 below the staged seal 116. The volume of fluid 213 in the piston chamber 214 may be any suitable fluid including but not limited to hydraulic fluid, oil and the like. The volume of fluid 213 or the pressure may then be translated through the bearing assembly 117*a* in response to the pressure exerted by the piston 200. The fluid pressure in the piston chamber 214 may be equal to the wellbore 106 pressure once the piston 200 transfers force from the pressure or force 212. In one exemplary embodiment, the fluid pressure applies a force to the pressure reduction system 118 as will be discussed in more detail below. Although the force exerted on the pressure reduction system 118 is described as being applied with fluid pressure, it should be appreciated that it may be applied mechanically in another exemplary embodiment.

Figure 3:
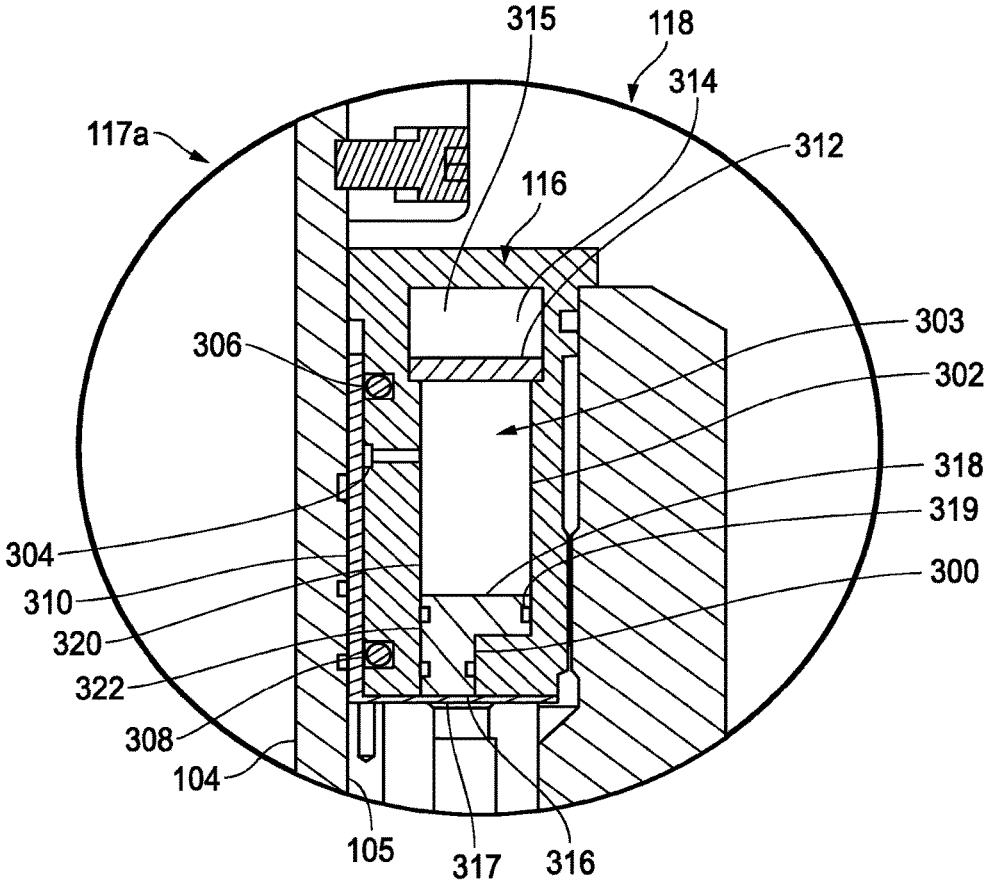
FIG. 3 depicts a cross sectional view of the staged seal according to the exemplary embodiment of FIG. 2.

FIG. 3 depicts a cross sectional view of the staged seal 116 according to an exemplary embodiment. The staged seal 116 may include the pressure reduction system 118 having a reduction piston 300 and a piston chamber 302, a volume of fluid 303, a fluid communication port 304, a top seal 306, a bottom seal 308, a wear sleeve 310, an optional accumulator piston 312 and an optional accumulator 314 (for fluid storage and/or heat expansion). The wear sleeve 310 is located adjacent to the inner member 104 and may be constructed of a hard and smooth material, for example, tungsten carbide, and may be replaceable if desired. The staged seal 116 may be configured to stage and reduce the wellbore pressure across the top seal 306 and the bottom seal 308 in a closed hydraulic circuit that does not require communication with an external control system, but which may utilize an external control system if desired (see for example, U.S. Pat. Nos. 8,353,337 and 8,408,297 which are hereby incorporated by reference).

The reduction piston 300 may have a first piston surface 316 having a first piston surface area 317, and a second piston surface 318 having a second piston surface area 319. The first piston surface area 317 as shown has a smaller surface area than the second piston surface area 319. The first piston surface 316 may be motivated by the wellbore pressure as described above. As the wellbore pressure acts on the first piston surface 316, the reduction piston 300 compresses the volume of fluid 303 in the piston chamber 302. However, because the surface area 319 of the second piston surface 318 is larger than the surface area 317 of the first piston surface 316, the pressure in the piston chamber 302 is decreased by the ratio of the surface areas 317 and 319. Therefore, the pressure in the piston chamber 302 will be less than the pressure exerted by the piston 200 (shown in FIG. 2), or the wellbore pressure. In an exemplary embodiment, the ratio of pressure reduction is 0.7, although it should be appreciated that any suitable ratio may be used to reduce the pressure.

Further, the ratio between the length 320 of the piston chamber 302 and the length 322 of the reduction piston 300 should be sufficient to prevent or inhibit the reduction piston 300 from entirely dislodging into, popping into, entering into the piston chamber 302, or exposing the entire lower surface area of the reduction piston 300 to wellbore pressure. Other means may also be used to prevent the reduction piston 300 from dislodging into the piston chamber 302, for example, but not limited to, a stop in the wall of piston chamber 302 that limits the movement of reduction piston 300. Means, such as drilled holes and guides (not shown), may also be added to keep the reduction piston 300 concentric within the piston chamber 302 and/or there-below The piston chamber 302 is a closed system, requiring no external control or access once in use. Once the wellbore 106 applies the reduced pressure from the second piston surface 318 on the volume of fluid 303 in the piston chamber 302, the pressure may not be changed by any external control in this exemplary embodiment. In an alternate exemplary embodiment, however, the pressure may be externally adjusted as desired by the operator of the drilling operation. The volume of fluid 303 in the piston chamber 302 may be a suitable fluid. Presently an incompressible fluid is preferred, such as, for example, so as to prevent the second piston 318 from overrunning or bypassing the port 304 in FIG. 3. Further, the volume of fluid 303 may be a suitable lubricant for the top seal 306 and bottom seal 308 including any type of oil or grease. The reduced pressure in the piston chamber 302 is communicated through the fluid communication port 304 to the wear sleeve 310, the top seal 306 and bottom seal 308. The wear sleeve 310 is located adjacent to the outer surface 105 of the inner member 104. The top seal 306 and bottom seal 308 seal against wear sleeve 310 as the wear sleeve 310 engages the inner member 104. The top seal 306 and bottom seal 308 may be made out of any suitable sealing material including, but not limited to elastomers, metal and the like. While the top seal 306 may be constructed of identical material to the bottom seal 308 in one exemplary embodiment, in another exemplary embodiment, the seals 306, 308 may be constructed of different materials from each other. By way of example only, the bottom seal 308 may be a KALSI seal, a seal specifically designed for low breakage because the bottom seal 308 experiences a higher pressure as compared to the top seal 306. The top seal 306 may be exposed to the reduced pressure of the piston chamber 302 on one side (the downhole side as shown) and atmospheric pressure on the other side (the uphole side as shown). The bottom seal 308 may be exposed to the reduced pressure of the piston chamber 302 on one side (the uphole side as shown) and approximately full wellbore pressure on the other side (the downhole side as shown). The reduced pressure in the top seal 306 and bottom seal 308 will increase the life of the seals without the need for external controls.

In compensation for expansion caused by heat/rotation, the optional accumulator piston 312 and an optional accumulator 314 may be used to further control the pressure or expansion in the piston chamber 302. The optional accumulator 314 may be a chamber, void, or receptacle filled with an amount of compressible, or pneumatic, fluid or gas 315 such as nitrogen, air and the like. The optional accumulator 314 may allow the amount of fluid or gas 315 in the piston chamber 302 to expand, contract, or otherwise fluctuate due to the effects of temperature without greatly changing the pressure in the piston chamber 302. As an alternative or in addition to the amount of fluid or gas 315, the optional accumulator 314 may include a spring (not illustrated) within that responds to fluctuations in the pressure by exerting tension on the optional accumulator piston 312. Further, the optional accumulator piston 312 and optional accumulator 314 may be tailored for the specific needs of the operation, such as specific sea level depth. Moreover, the amount or volume of fluid or gas 315 may be injected into the optional accumulator 314 at a specified temperature or pressure, or the operator may subsequently adjust the temperature of the amount of fluid or gas 315 (or chamber around it) to obtain different elastic properties from the optional accumulator 314. Alternatively, or additionally, the optional accumulator 314 may be used as a fluid storage area.

Figure 4:
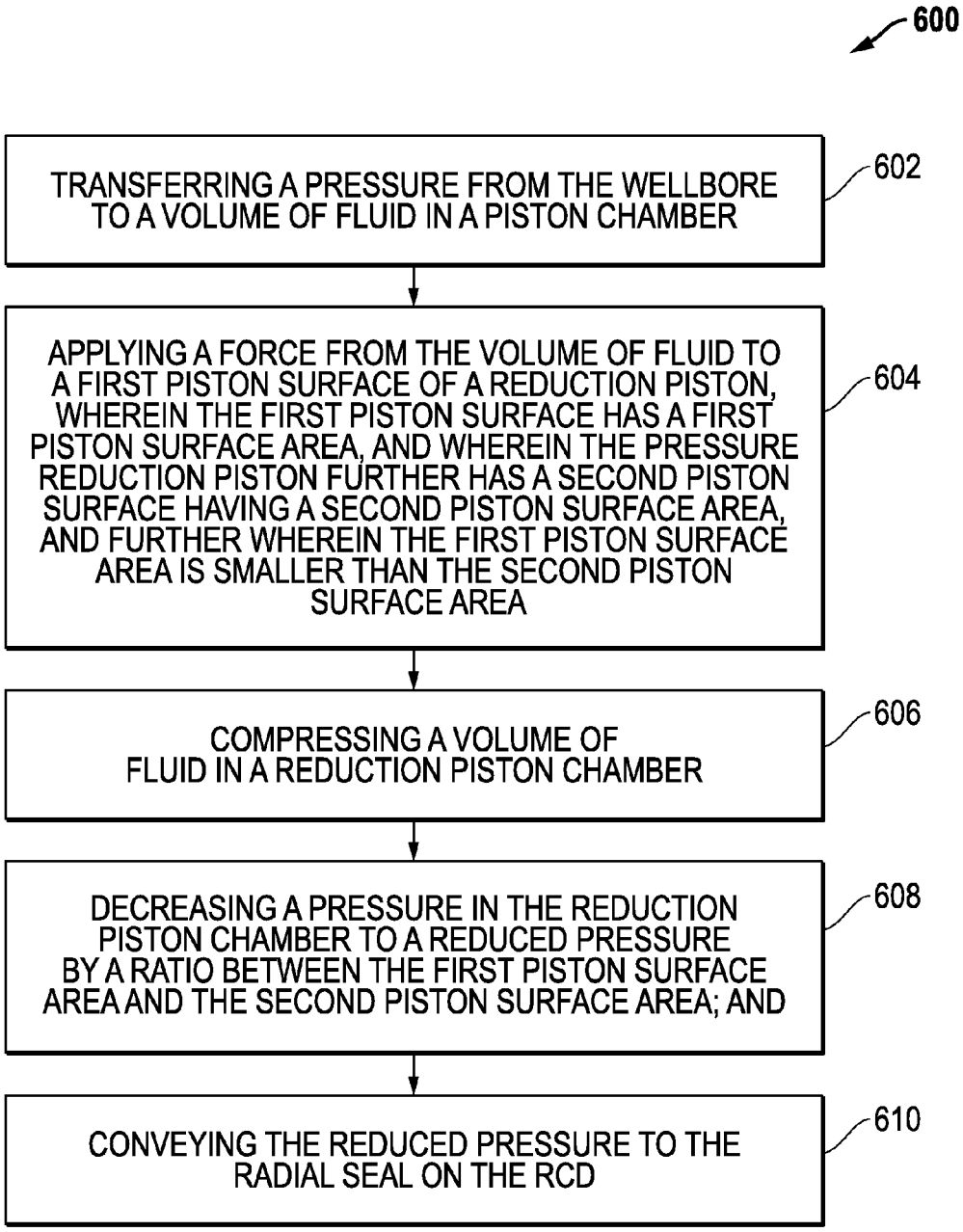
FIG. 4 depicts a method for reducing pressure in a radial seal on an RCD at a wellbore.

FIG. 4 depicts a flow chart 600 for one exemplary embodiment of a method for reducing pressure in a radial seal 116, or shaft seal(s) 306, 308 on an RCD 114 at a wellbore 106. The flow chart 600 begins at block 602 wherein a pressure is transferred from the wellbore 106 to a volume of fluid 213 in a piston chamber 214. Then the flow chart 600 continues at block 604, wherein a force from the volume of fluid 213 is applied to a first piston surface 316 of a reduction piston 300, wherein the first piston surface 316 has a first piston surface area 317, and wherein the reduction piston 300 further has a second piston surface 318 which has a second piston surface area 319, and further wherein the first piston surface area 317 is smaller than the second piston surface area 319. The flow chart 600 continues at block 606 wherein a volume of fluid 303 is compressed in a piston chamber 302. The flow chart 600 then proceeds to block 608 wherein a pressure is decreased in the piston chamber 302 to a reduced pressure by a ratio between the first piston surface area 317 and the second piston surface area 319. The flow chart 600 continues to block 610, wherein the reduced pressure is conveyed to the radial seal 116, or shaft seal 306, 308 on the RCD 114.

While the exemplary embodiments are described with reference to various implementations and exploitations, it will be understood that these exemplary embodiments are illustrative and that the scope of the inventive subject matter is not limited to them. Many variations, modifications, additions and improvements are possible. For example, although the exemplary embodiments have thus far been primarily depicted and described without a need for an external lubricant, coolant, lubrication systems, cooling systems and/or external control system, the exemplary embodiments described within may also be utilized in conjunction with external hydraulic control systems. For example, the implementations and techniques used herein may be applied to any strippers, seals, or packer members at the well site, such as the BOP, and the like.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An apparatus for reducing pressure in a radial seal on a rotating control device (RCD) at a wellbore, comprising: an inner member housed in the RCD, wherein the inner member has an outer surface; a wear sleeve adjacent to the outer surface of the inner member; a top seal in contact with the wear sleeve; a bottom seal in contact with the wear sleeve; wherein the wear sleeve is be sealed by the top seal and the bottom seal as the inner member rotates in the RCD; and a pressure reduction system mounted with the RCD and configured for pressure communication with wellbore pressure, whereby pressure is applied between the top seal and the bottom seal, the pressure between the seals being higher relative to a pressure above the top seal, and the pressure between the seals being lower relative to a pressure below the bottom seal.

2. The apparatus of claim 1, wherein the pressure reduction system is a closed hydraulic system.

3. The apparatus of claim 1, wherein the pressure reduction system further comprises a reduction piston having a first piston surface exposed to a first volume of fluid and a second piston surface configured to motivate a second volume of fluid within a reduction piston chamber.

4. The apparatus of claim 3, wherein the first piston surface has a first piston surface area and the second piston surface has a second piston surface area, and wherein the first piston surface area is less than the second piston surface area.

5. The apparatus of claim 4, wherein the ratio between the first piston surface area and the second piston surface area is less than or equal to 0.7 of the wellbore pressure.

6. The apparatus of claim 5, further comprising an accumulator within the reduction piston chamber, wherein the accumulator includes a receptacle.

7. The apparatus of claim 6, wherein the receptacle further includes an amount of compressible gas therein.

8. The apparatus of claim 6, wherein the receptacle further includes a compressible spring therein.

9. The apparatus of claim 1, further comprising a fluid communication port configured to allow fluid communication between the pressure reduction system and the RCD.

10. The apparatus of claim 3, wherein the second volume of fluid is an incompressible fluid.

11. A system for increasing the longevity of a rotating control device (RCD) at a wellbore, comprising: a bearing assembly configured for operating in the RCD; wherein the bearing assembly is configured for reducing pressure around the bearing assembly, wherein the bearing assembly configured for reducing pressure comprises a system for reducing pressure and friction in a radial seal on the RCD at the wellbore comprising: an inner member mounted in the bearing assembly, wherein the inner member is configured to engage a piece of oilfield equipment as the piece of oilfield equipment passes through the RCD, and further wherein the inner member has an outer surface; a piston coupled to the bearing assembly, wherein the piston is configured to compress a first volume of fluid in a piston chamber; and a pressure reduction system mounted with the RCD comprising: a wear sleeve adjacent to the outer surface of the inner member; a top seal adjacent to the wear sleeve; a bottom seal adjacent to the wear sleeve; wherein the wear sleeve is configured to be sealed by the top seal and the bottom seal as the inner member rotates in the RCD; a fluid communication port configured to allow fluid communication between the pressure reduction system and the wear sleeve; and wherein the pressure reduction system is configured to apply a pressure via a wellbore pressure between the top seal and the bottom seal, which wherein the pressure between the seals is higher relative to a pressure above the top seal, and which wherein the pressure between the seals is lower relative to a pressure below the bottom seal.

12. The system of claim 11, wherein the pressure reduction system is a closed hydraulic system.

13. The system of claim 11, wherein the pressure reduction system further comprises a reduction piston having a first piston surface exposed to a pressure in the piston chamber and a second piston surface configured to motivate a second volume of fluid within a reduction piston chamber.

14. The system of claim 13, wherein the first piston surface has a first piston surface area and the second piston surface has a second piston surface area, and wherein the first piston surface area is less than the second piston surface area.

15. The system of claim 14, wherein the ratio between the first piston surface area and the second piston surface area is less than or equal to 0.7 of the pressure in the piston chamber.

16. The system of claim 15, further comprising an accumulator within the reduction piston chamber, wherein the accumulator includes a receptacle.

17. The system of claim 16, wherein the receptacle further includes an amount of compressible gas therein.

18. The system of claim 16, wherein the receptacle further includes a compressible spring therein.

19. The system of claim 13, wherein the second volume of fluid is an incompressible fluid.

20. A method for reducing pressure in a radial seal on a rotating control device (RCD) at a wellbore, comprising the steps of: transferring a pressure from the wellbore to a first volume of fluid in a piston chamber; applying a force from the first volume of fluid to a first piston surface of a reduction piston, wherein the first piston surface has a first piston surface area, and wherein the reduction piston further has a second piston surface having a second piston surface area, and further wherein the first piston surface area is less than the second piston surface area; compressing a second volume of fluid in a reduction piston chamber; decreasing a pressure in the reduction piston chamber to a reduced pressure by a ratio between the first piston surface area and the second piston surface area; and conveying the reduced pressure to the radial seal on the RCD.

21. The method according to claim 20, wherein the step of transferring a pressure from the wellbore to a first volume of fluid in a piston chamber comprises the steps of:

applying the pressure from the wellbore to a piston located within the RCD;

moving the piston towards the piston chamber; and compressing the first volume of fluid within the piston chamber.

22. The method according to claim 20, wherein the step of conveying the reduced pressure to the radial seal on the RCD comprises the step of transferring the reduced pressure through a fluid communication port to a wear sleeve, a top seal, and a bottom seal.

23. The method according to claim 20, further comprising the step of:

regulating the pressure in the reduction piston chamber with an accumulator piston and an accumulator, wherein the accumulator is filled with an amount of compressible gas.

24. The method according to claim 23, wherein the step of regulating the pressure in the reduction piston chamber comprises the steps of:

allowing the second volume of fluid to fluctuate due to pressure change; and compensating for fluctuation of the second volume of fluid with the amount of compressible gas in the accumulator.

25. The method according to claim 24, further comprising the step of adjusting the temperature of the amount of compressible gas.

26. The method according to claim 20, further comprising the steps of:

regulating the pressure in the reduction piston chamber with an accumulator piston and an accumulator, wherein the accumulator includes a compressible spring;

allowing the second volume of fluid to fluctuate due to pressure change; and compensating for fluctuation of the second volume of fluid with the compressible spring.

27. A method for reducing pressure in a radial seal on a rotating control device (RCD) at a wellbore, comprising the steps of: transferring wellbore pressure to a pressure reduction system of the RCD; reducing the pressure in the pressure reduction system; and applying the reduced pressure between a top seal and a bottom seal and between a fixed component and a rotating component of the RCD, wherein the reduced pressure is higher relative to a pressure above the top seal, and wherein the reduced pressure is lower relative to a pressure below the bottom seal.

* * * * *